US012742337B2

(12) United States Patent
Exton

(10) Patent No.: US 12,742,337 B2
(45) Date of Patent: Sep. 22, 2026

(54) SEISMIC DISSIPATOR

(71) Applicant: BRL PATENTS LIMITED, Christchurch (NZ)

(72) Inventor: Benjamin John Exton, Christchurch (NZ)

(73) Assignee: BRL PATENTS LIMITED, Christchurch (NZ)

( * ) Notice: Subject to any disclaimer, the term of this patent is extended or adjusted under 35 U.S.C. 154(b) by 448 days.

(21) Appl. No.: 18/279,500

(22) PCT Filed: Feb. 28, 2022

(86) PCT No.: PCT/IB2022/151714
§ 371 (c)(1),
(2) Date: Aug. 30, 2023

(87) PCT Pub. No.: WO2022/185174
PCT Pub. Date: Sep. 9, 2022

(65) Prior Publication Data

US 2025/0084660 A1 Mar. 13, 2025

(30) Foreign Application Priority Data

Mar. 1, 2021 (NZ) ..... 773359

(51) Int. Cl.
*E04H 9/02* (2006.01)

(52) U.S. Cl.
CPC ..... *E04H 9/0237* (2020.05); *E04H 9/028* (2013.01)

(58) Field of Classification Search
CPC ..... E04H 9/0237
See application file for complete search history.

(56) References Cited

U.S. PATENT DOCUMENTS

2004/0219807 A1* 11/2004 Weiss ..... H01R 13/2414 439/91
2025/0084660 A1* 3/2025 Exton ..... E04H 9/0237

FOREIGN PATENT DOCUMENTS

CN 212078312 U 12/2020
WO WO-2014069972 A1 * 5/2014 ..... E04H 9/0237

OTHER PUBLICATIONS

Patent examination report 1 issued on Oct. 30, 2023 in NZ Application No. 785618.

* cited by examiner

*Primary Examiner* — Brian D Mattei
(74) *Attorney, Agent, or Firm* — Finnegan, Henderson, Farabow, Garrett & Dunner, LLP

(57) ABSTRACT

A seismic device, has a housing configured to be engaged with a first structure, and a plurality of pairs of crossmembers, each pair of crossmembers being configured to receive part of a baseplate member which is configured to be engaged with a second structure. The crossmembers of each pair are biased toward each other to provide a frictional force to the baseplate member to resist axial movement of each crossmember pair relative to the baseplate member.

21 Claims, 9 Drawing Sheets

SEISMIC DISSIPATOR

CROSS-REFERENCE TO RELATED APPLICATIONS

This application is a national stage of International Application No. PCT/IB2022/051714, filed Feb. 28, 2022, which claims the benefit of priority of New Zealand Application No. 773359, filed on Mar. 1, 2021, the entire contents of both of which are incorporated herein by reference.

FIELD

This disclosure relates to seismic apparatus commonly referred to by many terms such as seismic dissipator or base isolator, referred to as a seismic device and/or dissipator for the purposes of this specification. Seismic devices are typically used to provide protection to structures such as buildings in the event of an earthquake or similar seismic disturbance.

BACKGROUND

Earthquake protection is beneficial for structures, especially in regions of heightened seismic risk. Many countries, such as those around the Pacific rim have experienced devastating earthquakes and the seismic safety of structures is a significant issue.

Seismic devices provide a way to prevent a structure having to fully follow ground movement as the ground shakes during an earthquake. Therefore, seismic devices are designed to reduce the forces and accelerations applied to a structure during an earthquake and in so doing prevent damage to that structure. This requires the seismic device to be designed to allow some degree of movement to occur, or to absorb or dissipate a certain amount of energy, or some combination of these two characteristics.

A number of seismic devices have been proposed and most rely on some form of elastic or resilient material to help absorb the forces and also in many cases another material, or the use of friction, to absorb some of the energy resulting from the ground movement.

Known forms of seismic devices include materials such as rubber and lead. Rubber acts as a resilient material to absorb energy so that sudden changes in the magnitude or direction of a force are not immediately passed from a foundation to a structure, and to allow the structure to return to a rest position relative to the foundation. Lead can act as a damper to dissipate energy as heat. One of the difficulties with these known devices is that they require relatively expensive and specialised construction, and the materials can need maintenance and replacement—rubber for example perishes.

There have been some other proposals for seismic devices that do not necessarily use materials that deform within their elastic limits, often utilising mechanical friction or some other means, but these tend to provide only a very limited number of axes of movement of the foundation relative to the structure or between structural elements, often through a single axis only. Others use materials that deform plastically, meaning that the apparatus might fail in the event of sudden aftershocks, or at least needs to be repaired or replaced after a significant earthquake occurs.

There is a need for seismic devices that provide dissipation, recentering, and/or isolation performance during seismic events yet are relatively efficient in terms of costs, installation procedures and maintenance.

OBJECT

It is an object of the present disclosure to provide a seismic device, in particular a dissipator, which at least goes some way toward overcoming disadvantages of prior proposals, or which at least provides a useful alternative.

SUMMARY

In one aspect, the present disclosure provides a seismic dissipator, the dissipator comprising

- a housing configured to be engaged with a supported structure,
- a plurality of pairs of crossmembers associated with the housing, each pair of cross members being configured to receive a baseplate member or a part of a baseplate member,
- the baseplate member to be configured to be engaged with a supporting structure,
- the crossmembers of each pair being biased toward each other to thereby provide a frictional force to the baseplate member to resist axial movement of each crossarm pair relative to the baseplate member.

The crossmembers of each pair may be profiled so as to provide a restoring or recentering force to return the device to its at-rest position.

The first structure may comprise a supported structure. The supported structure will typically be located vertically above the dissipator. The supported structure may include, without limitation, buildings, tanks, storage racking and equipment.

The second structure may comprise a supporting structure. The supporting structure will typically be located vertically beneath the dissipator. The supporting structure may include, without limitation, a foundation.

In another aspect the present disclosure provides a system comprising

- a baseplate member,
- a housing configured to be engaged with a supported structure,
- a plurality of pairs of crossmembers associated with the housing, each pair of cross members being configured to receive the baseplate member,
- the crossmembers of each pair being biased toward each other to thereby provide a frictional force to the baseplate member to resist axial movement of each crossmember pair relative to the baseplate member.

In another aspect the present disclosure provides a method of seismic dissipation for a structure, the method comprising

- receiving a baseplate member in a plurality of pairs of crossmembers, and
- biasing the crossmembers of each pair being toward each other to thereby provide a frictional force to the baseplate member to resist axial movement of each crossmember pair relative to the baseplate member.

In another aspect the present disclosure provides a seismic dissipation apparatus comprising

- a housing configured to be engaged with a first structure,
- a plurality of pairs of crossmembers associated with the housing, each pair of cross members being configured to receive a part of a baseplate member,
- the crossmembers of each pair being biased toward each other to thereby provide a frictional force to the baseplate member to resist axial movement of each crossmember pair relative to the baseplate member.

In another aspect the disclosure provides a seismic device, the device comprising a housing configured to be engaged with a first structure, a plurality of pairs of crossmembers associated with the housing, each pair of cross members being configured to receive a projecting member, the projecting member configured to be engaged with a second structure, the crossmembers of each pair being biased toward each other to thereby provide a frictional force to the projecting member to resist axial movement of each crossmember pair relative to the projecting member.

Other aspects may also be said broadly to consist in a system, apparatus or method comprising the parts, elements and features referred to or indicated in the specification of the application, individually or collectively, in any or all combinations of two or more of said parts, elements or features, and where specific integers are mentioned herein which have known equivalents in the art to which the invention relates, such known equivalents are deemed to be incorporated herein as if individually set forth.

Further aspects are also found in the appended claims.

DRAWINGS

One or more embodiments of the invention will now be described with reference to the accompanying drawings, in which.

In this document, like reference numerals are used throughout the drawings to denote like features in the various constructions, embodiments or examples disclosed.

DETAILED DESCRIPTION

In this specification, where reference has been made to external sources of information, including patent specifications and other documents, this is generally for the purpose of providing a context for discussing the features of the present invention. Unless stated otherwise, reference to such sources of information is not to be construed, in any jurisdiction, as an admission that such sources of information are prior art or form part of the common general knowledge in the art.

As used herein the term "and/or" means "and" or "or", both. The term "comprising" as used in this specification means "consisting at least in part of". When interpreting statements in this specification which include that term, the features prefaced by that term in each statement all need to be present, but the other features can also be present. Related terms such as "comprise" and "comprised" are to be interpreted in the same matter.

Figure 1:
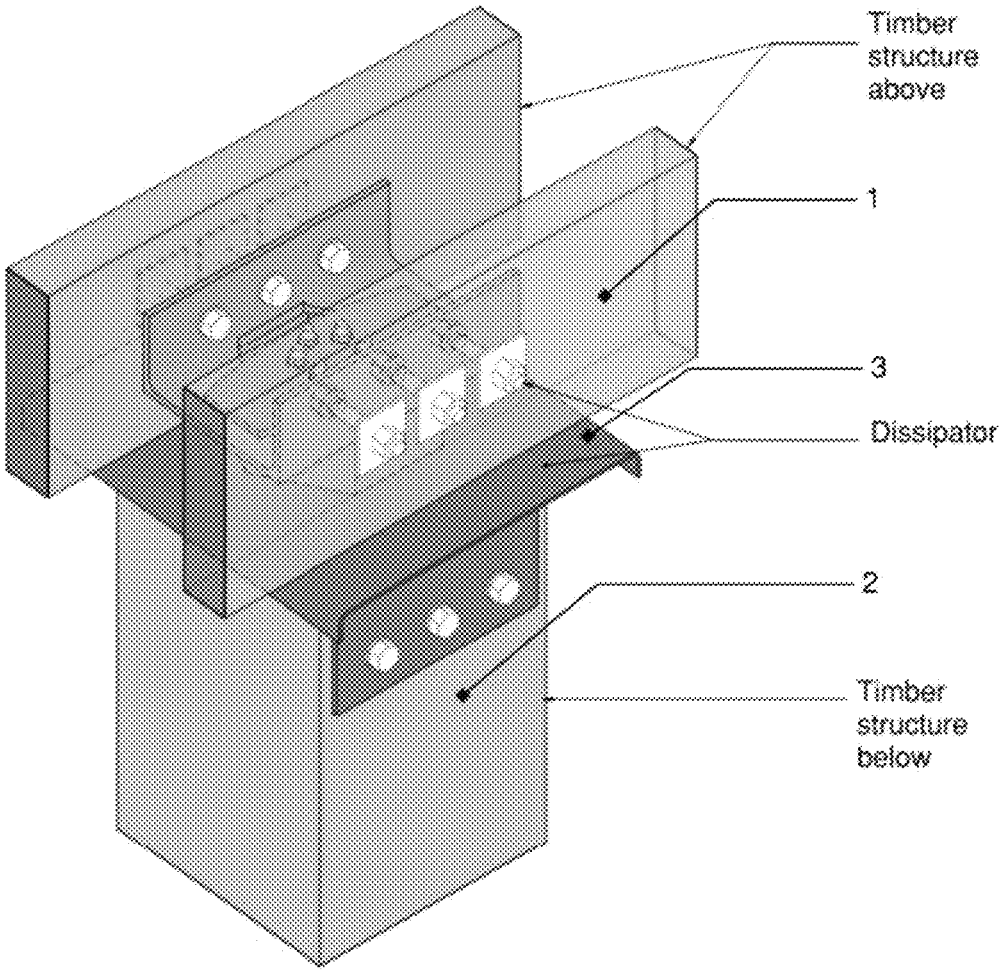
FIG. 1 is an isometric view of the device in a timber-framed structural system.
Figure 2:
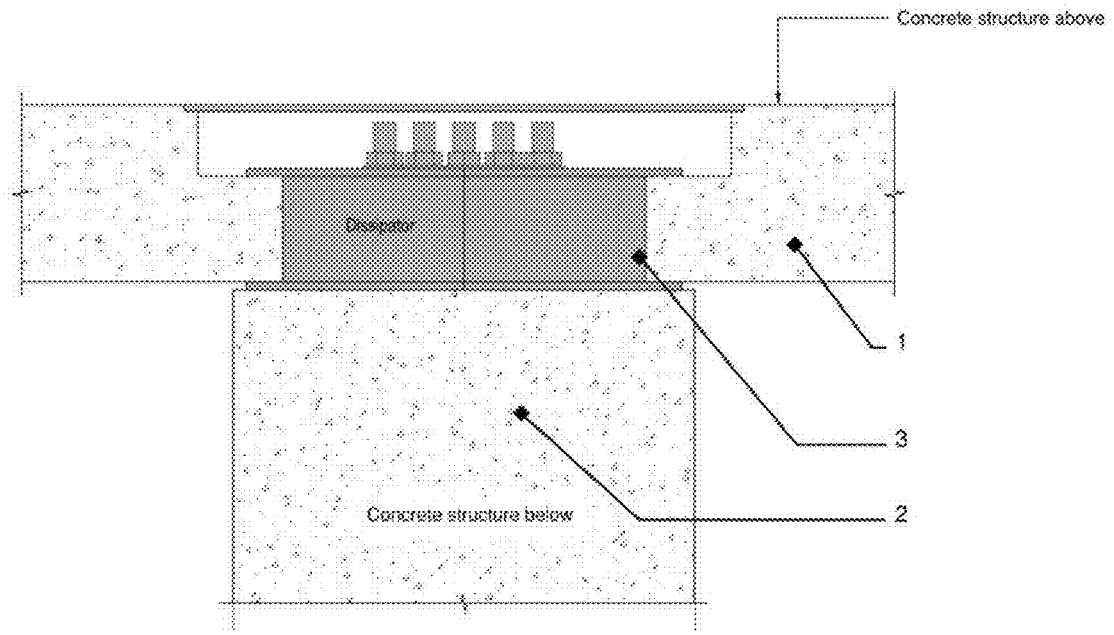
FIG. 2 is a diagrammatic view of the device configured to suit a concrete structural system.
Figure 3:
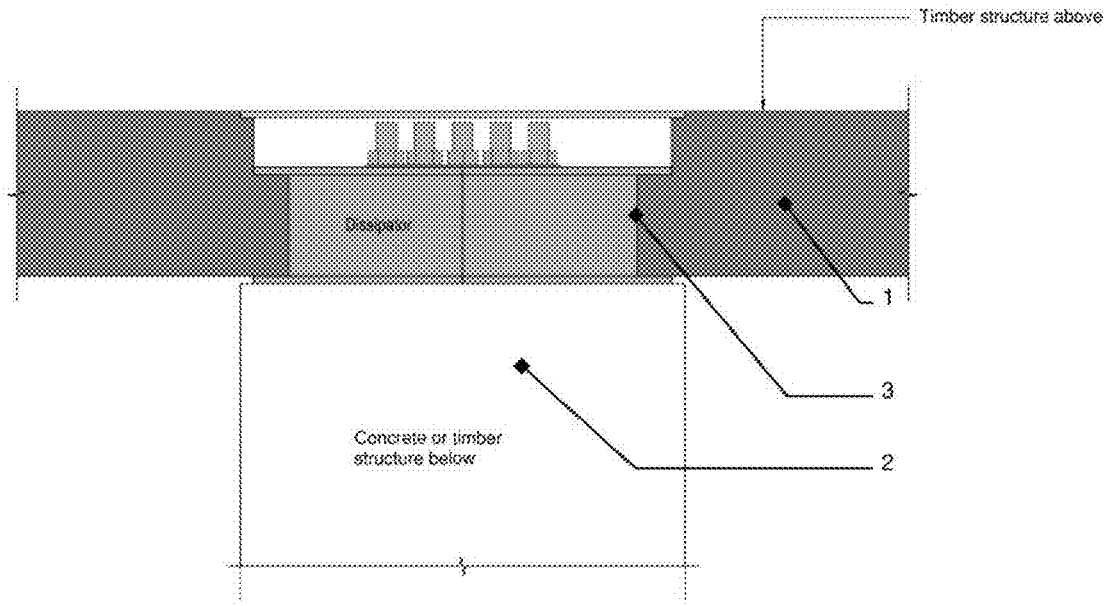
FIG. 3 is a diagrammatic view of the device configured to suit a mass-timber structural system.

In order to provide context to the installation of the present invention and an example of a possible overall assembly and environment in which it is intended to be used, an example is shown in FIG. 1 in which a diagrammatic illustration of a subfloor framing 1 supported on a foundation system 2 is shown. An assembly such as this can be replicated a number of times around a typical structure depending on the requirements of a structure's design. The supported structure and supporting structure may comprise any form of suitable types and as such is not described in any detail herein, as appropriate systems are known to those skilled in the art to which the invention relates. FIGS. 2 and 3 show two such alternative arrangements. A first structure, such as subfloor framing 1, is referred to generally in this document as a supported structure. A second structure, such as foundation 2 is referred to generally in this document as a supporting structure. The supported and supporting structures will in most embodiments be located above and beneath the dissipator apparatus, but the system is not limited to this arrangement.

In some embodiments the seismic device system relating to the present invention comprises a plurality of seismic devices which are referenced 3 in FIG. 1.

In FIG. 1, the seismic device 3 is shown connected to a pair of bearers 1 and foundation pile 2. Although this is a preferred arrangement and is described by way of example below, it will be appreciated that other structural engagement arrangements between the supported structure 1 and the, or each, dissipator 3 are possible. Moreover, although structure 1 is shown as timber frame which is in accordance with one embodiment, it will be understood that other supported structures, as well as other supporting structures 2 may also be used with the seismic device 3 disclosed herein.

Turning to FIGS. 2 and 3, section views of two other such configurations of supported structure 1, supporting structure 2 and the seismic device 3, are shown.

Figure 4:
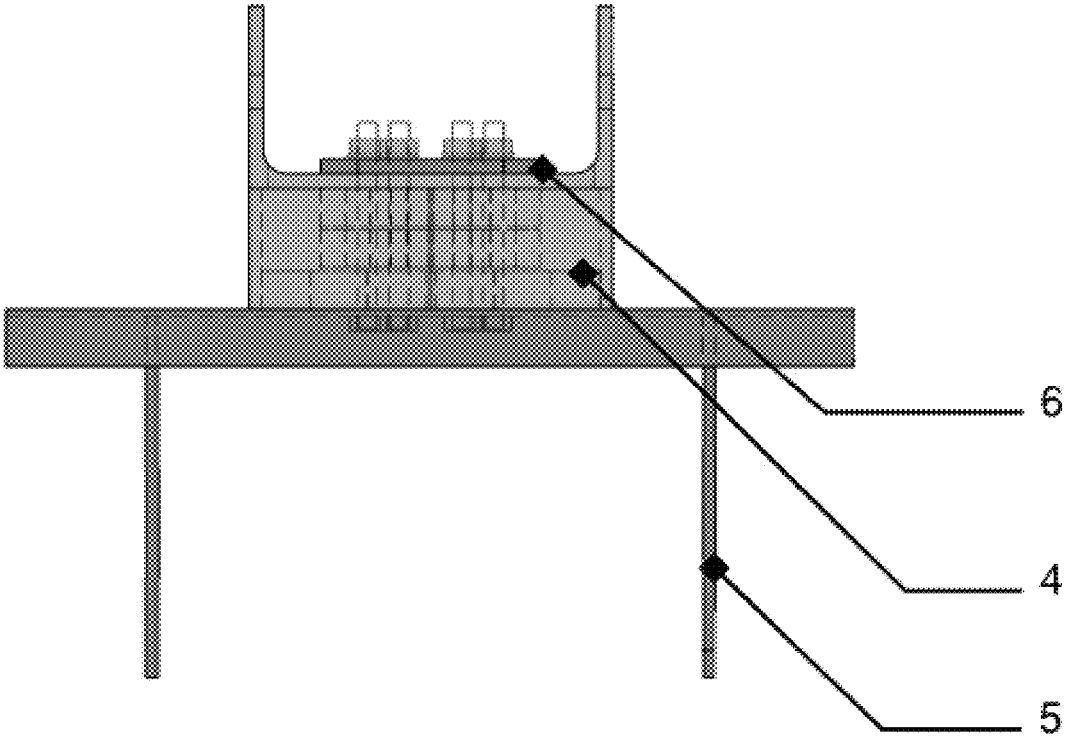
FIG. 4 is a front elevation of the apparatus as shown in FIG. 1.
Figure 5:
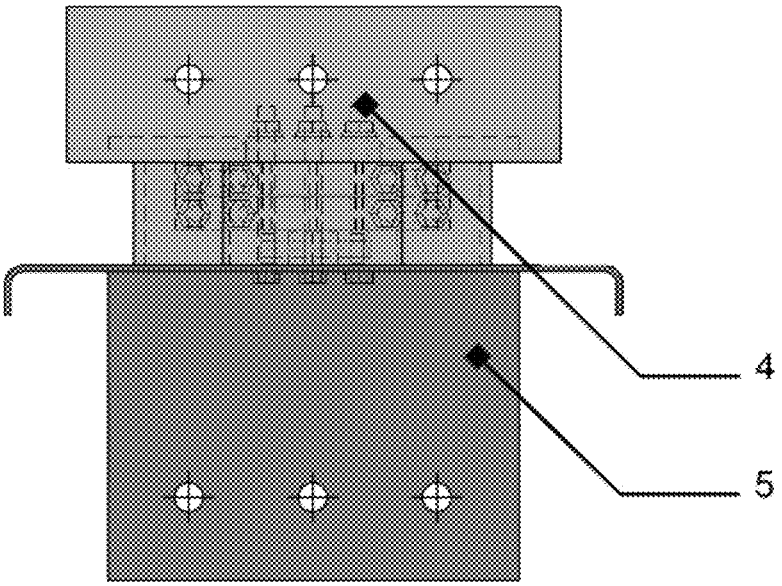
FIG. 5 is a side elevation showing apparatus as shown in FIG. 1.

As can be seen in FIGS. 4 and 5, and more clearly seen and described further below, the seismic device comprises a housing 4 that is configured for connection to the supported structure, and a baseplate member 5 that is configured for connection to the supporting structure. The housing 4 may simply comprise an outer wall or walls, as will be apparent from the description further below. Therefore, in some embodiments the housing does not need to comprise a full enclosure. For example, the supporting or supported structures may provide a part of the housing. Also, in some embodiments the housing may be associated or configured for connection to the supporting structure and the baseplate member may be configured for connection to the supported structure.

Coverplate 6 is installed over the top of housing 4 in the embodiment illustrated, to be connected to the baseplate member 5 vertically, but enable it to slide laterally within bounds.

Figure 6:
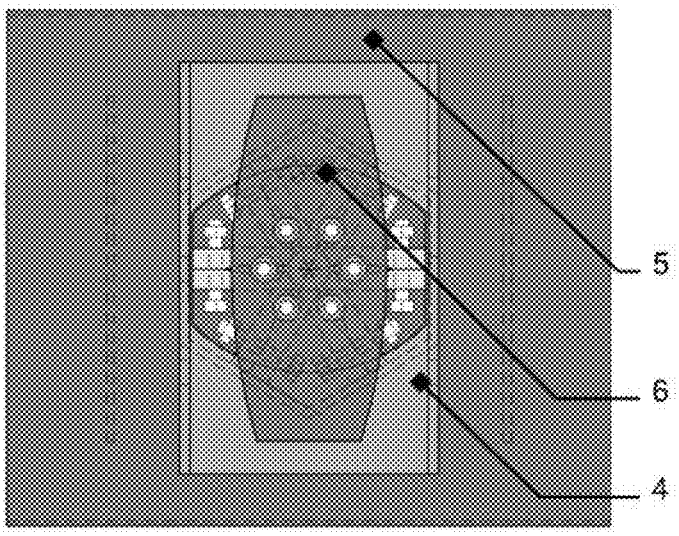
FIG. 6 is a plan view of FIGS. 4 and 5.

FIG. 6 provides a plan view of parts of an assembly according to an embodiment.

Figure 7:
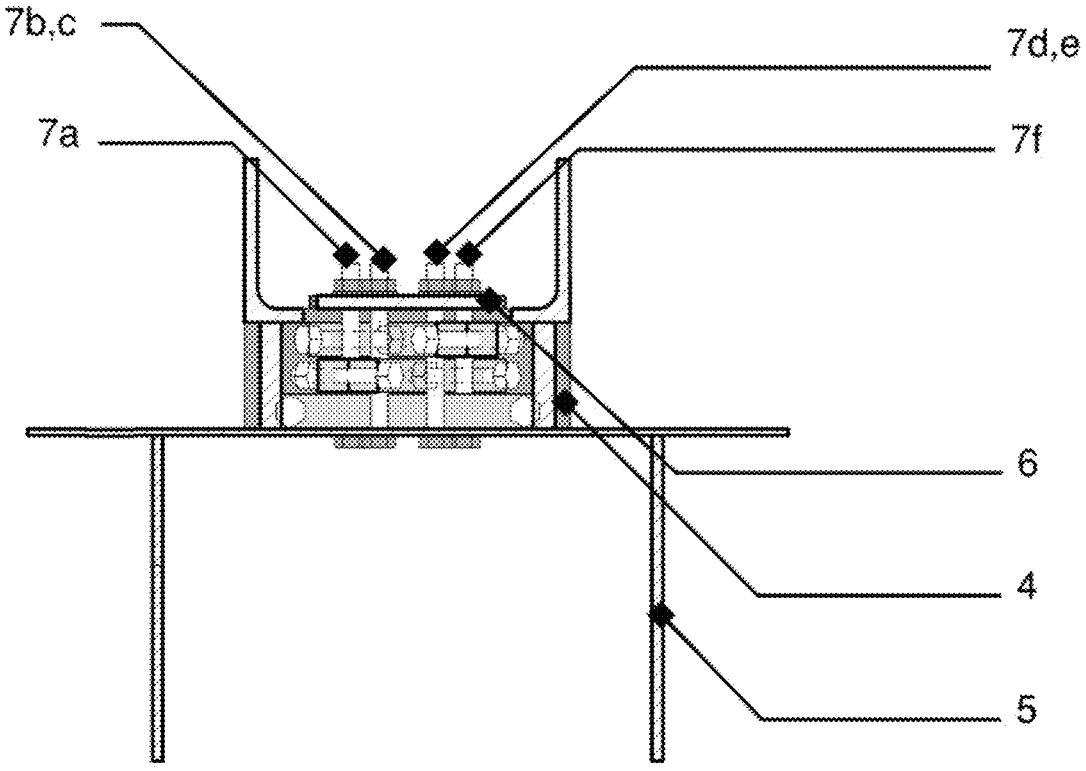
FIG. 7 is an elevation in cross section of the apparatus of FIGS. 4, 5 and 6.

FIG. 7 shows the first view of the inner workings of the seismic device in cross-section. A coverplate 6 and baseplate member 5 are connected either side of the housing 4 with a number of elongate assemblies 7. These assemblies could comprise of a nut and bolt assembly or some other assembly to achieve the same. This may be affected by welding the elongate assemblies 7 to baseplate member 5 and coverplate 6, although other attachment configurations are possible. In one example, the relevant parts of the members 7 may be threaded, and nuts may be engaged with the threaded portions and be tensioned relative to each other to securely locate coverplate 6 to baseplate member 5 with housing 4 located between these. As set forth above, the housing 4 may be operatively connected with another part of supported structure 1 and the baseplate member 5 with another part of supporting structure 2 if desired.

Figure 8:
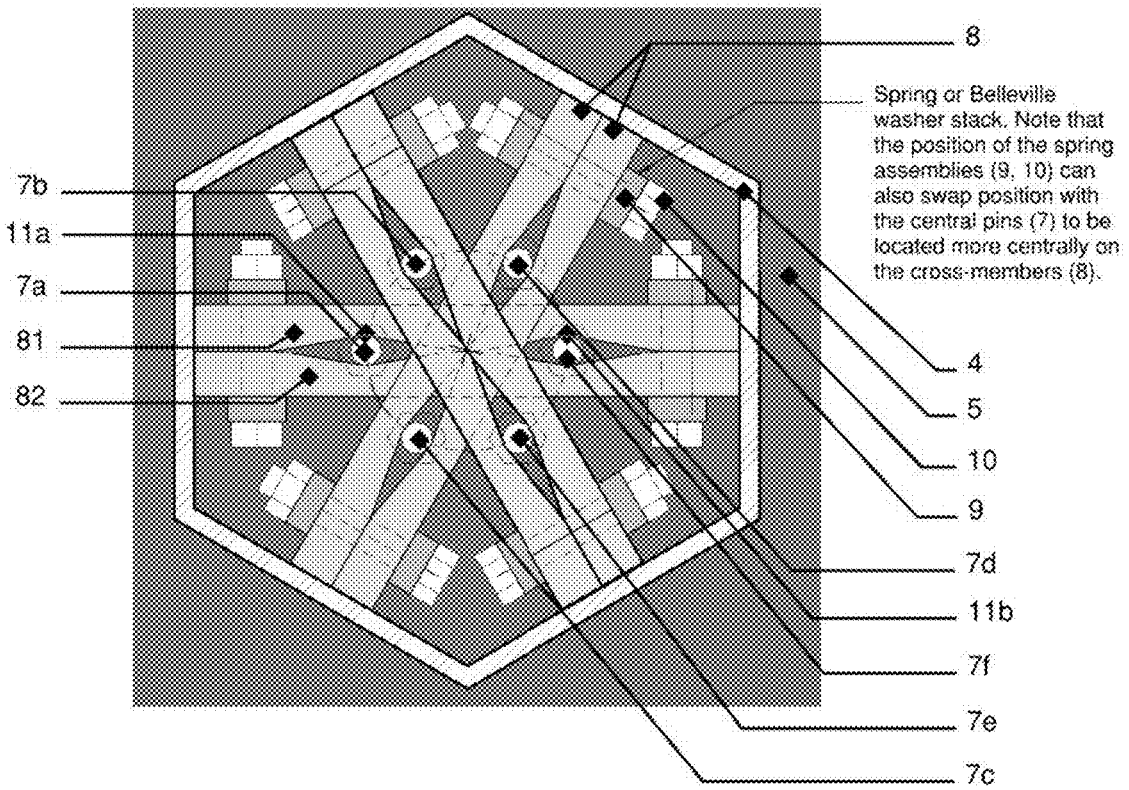
FIG. 8 is a plan view in cross section of the apparatus of FIG. 7, including an enlargement.

Turning to FIG. 8, the dissipator apparatus 3 is shown in enlarged partial cross-sectional plan. In an embodiment, one or more projections 7 are provided which comprise part of, for example being directly or indirectly dependent from, baseplate member 5. In an embodiment the projections 7 comprise pins. In an embodiment the pins are elongate. There are six elongate members 7 in the embodiment illustrated. However, as will be clear to those skilled in the art, there may in some embodiments be fewer than six elongate members 7, or more than six elongate members 7. The elongate members 7 project through the centre of housing 4, but are not connected to it. In the example illustrated, the elongate members 7 are connected to coverplate 6 and the baseplate member 5.

As can be seen from FIG. 8, the housing 4 is free to move differentially from the other elements within bounds. Reverting back to FIG. 1, this shows that the upper structure 1 is free to move laterally to the lower structure 2 in the horizontal plane (i.e. in a plane that is generally orthogonal or perpendicular to the longitudinal axis of the members 7) whilst remaining fixed in the vertical plane (i.e. in a plane that is generally parallel with the longitudinal axis of the members 7).

Baseplate member 5 extends horizontally beyond the periphery of housing 4. As shown in FIGS. 1 and 5, this extension is to provide adequate vertical plane seating for supported structure 1 in the event of the movement of the seismic device 3 as set forth above.

Figure 9:
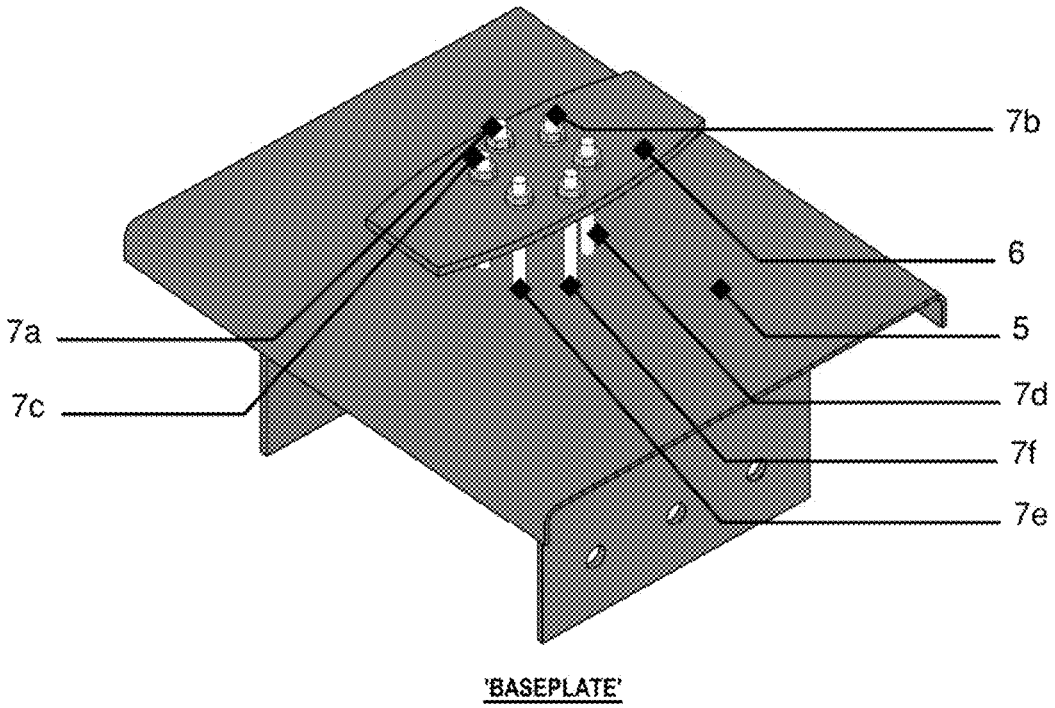
FIG. 9 is an isometric view of the baseplate assembly only.
Figure 10:
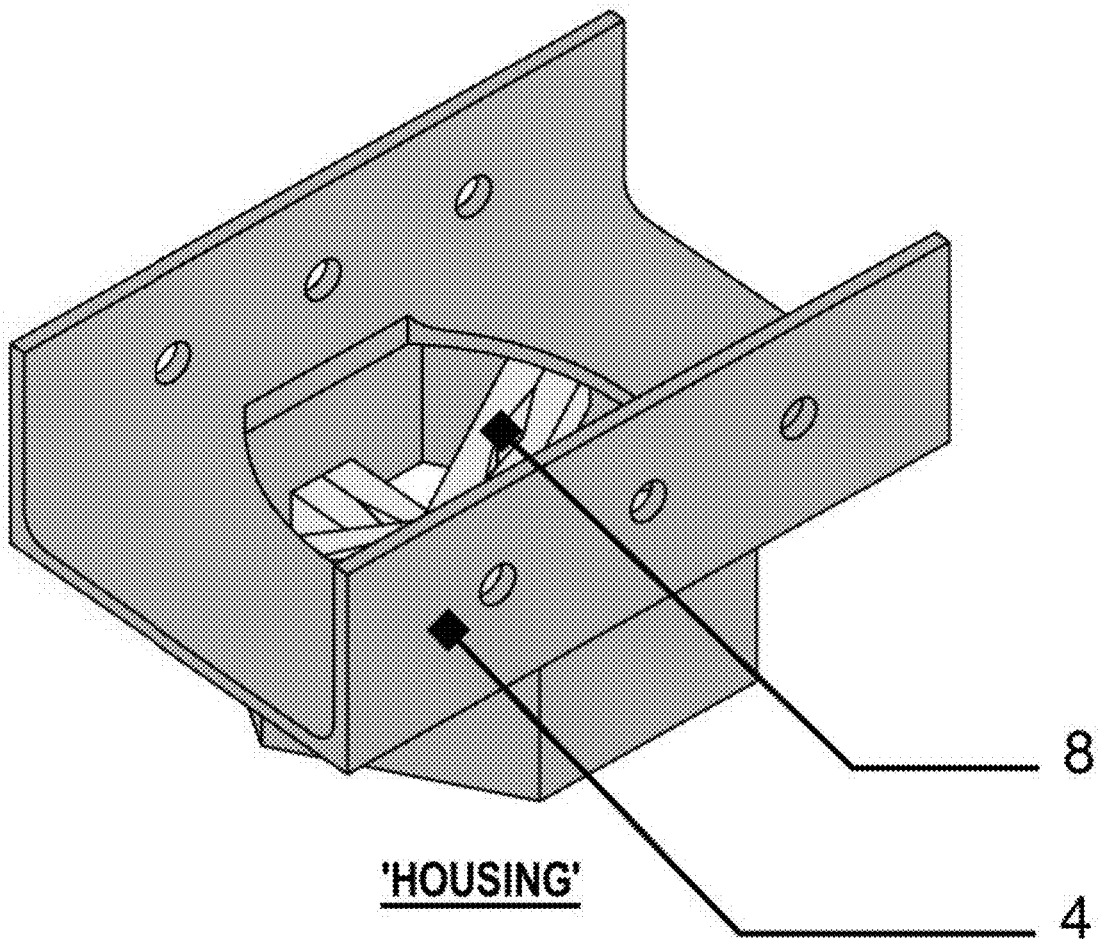
FIG. 10 is an isometric view of the housing assembly only.
Figure 11:
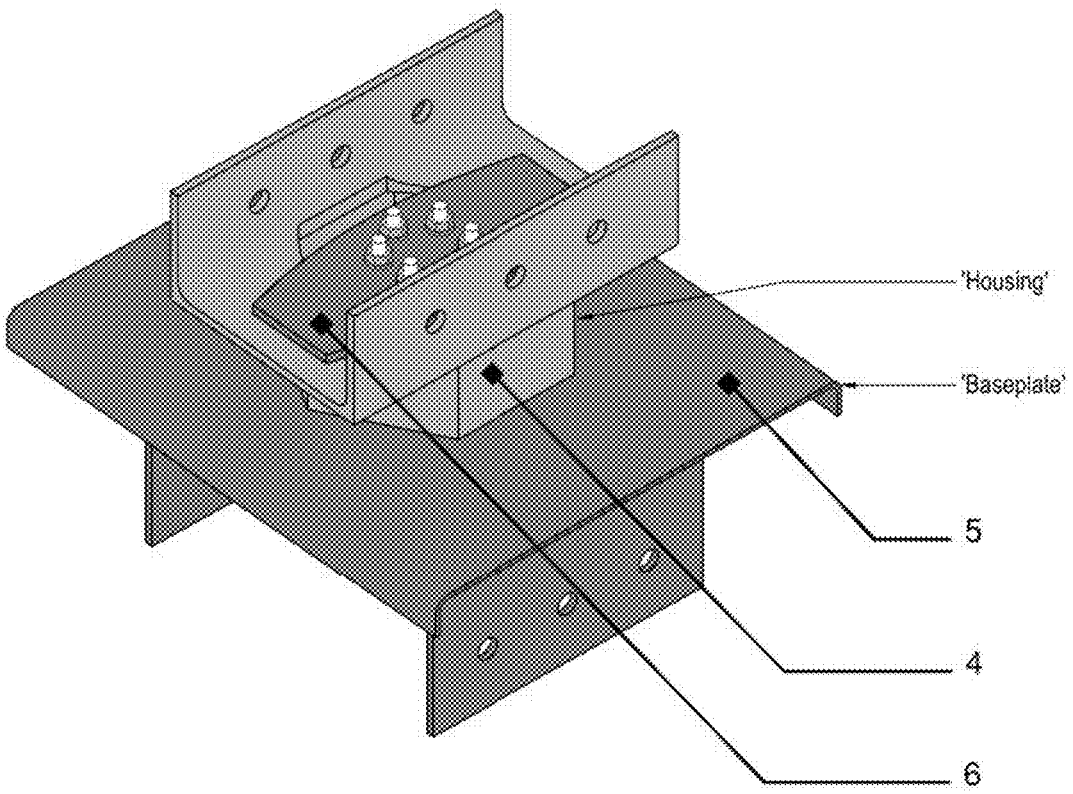
FIG. 11 is an isometric view combining the elements shown in FIGS. 9 & 10.

Housing 4 has upper and lower interfaces configured so as to be capable of sliding relative to the baseplate member 5 and the coverplate 6. For clarity, the elements shown in FIG. 9 move differentially to those shown in FIG. 10, with the combined view of these two figures shown in FIG. 11.

FIG. 8 shows the overall shape of housing 4. In this example the housing is hexagonal in plan view. However, when considering this disclosure in its entirety, those skilled in the art will appreciate that other geometries are possible. For example, in some embodiments there may be fewer sides, such as four, or more sides, such as eight.

The assembly within housing 4 provides a mechanism that controls relative horizontal movement between housing 4 and the plates 5, 6. This mechanism therefore controls movement between the supporting structure 2 and supported structure 1, and will now be described with reference to FIGS. 8, and 12-16.

Referring to FIG. 8, it will be seen that housing 4 houses a plurality of pairs of crossmembers 8. Each pair of crossmembers comprises a first crossarm 81 and a second crossarm 82. Crossarms 81 and 82 operate together, being biased toward each other as will be described further below.

Figure 14:
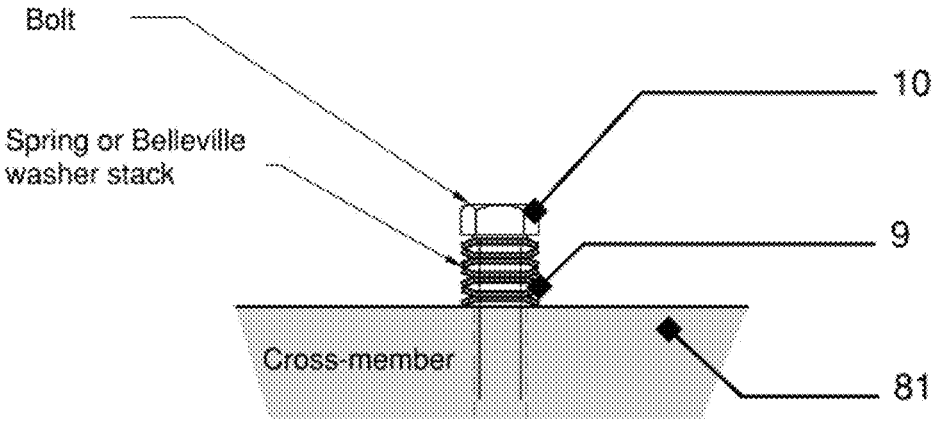
FIG. 14 is a larger view of the end of a crossmember from the preceding FIGS. 12 and 13.

In the example illustrated, the biasing arrangement comprises clamping mechanisms 10 which are located on either side of the crossarm pairs 8. In the preferred embodiment the clamping mechanism is of bolt and nut form however those skilled in the art will appreciate that other mechanisms are possible to achieve the same. The bolts 10 being pretensioned with a springing mechanism 9 in order to provide a force directing the crossarms 81 and 82 toward each other. FIG. 14 shows one example of a biasing arrangement in which bolt 10 constrains a springing assembly 9 so that crossarm 8 is biased away from the end of the bolt 10, and toward the opposing crossarm of the pair. The biasing force that is applied can be adjusted by modification of spring properties or the selection of the Belleville washer stack-washers (for example the number or lay-up of washers and/or and spring constant) and the tension applied to the bolt or bolts 10. The applied force, along with the coefficient of friction between the inner surfaces of each crossarm 81, 82 and the outer surfaces of the adjacent member 7 creates a friction force that resists relative movement between the members 7 and each crossarm along the longitudinal axis of each crossarm. This controls movement between the supported structure 1 and supporting structure 2 by providing a force that resists relative movement and assists with absorbing energy.

Each pair of crossmembers 8 receives a number of the elongate members 7. In the example shown, each pair 8 receives two of 7*a*-7*f*, a pair of these across the device. There are six members 7*a*-7*f* equally spaced about the centroid of baseplate 5. There are three crossarm pairs 8. The first pair receives members 7*a* and 7*f*. The second pair receives 7*b* and 7*e*. The third pair receives 7*c* and 7*d*. The pairs 8 are located one above the other as shown in FIG. 7, and the ends of each pair 8 abut a corresponding wall of the housing 4. Therefore, the crossarm pairs 8 cannot move axially relative to housing 4 but may move parallel to the housing wall 4 that they abut.

Furthermore, each arm 81, 82 is contoured on an inner surface thereof to provide one or more movement control regions 11. The movement control regions for the first crossarm pair (receiving 7*a* and 7*f*) are indicated by arrows 11*a* and 11*b* FIG. 8. The movement control regions are created by providing the inner surface of each arm 81, 82 (i.e. the surface facing the other arm) with a contour whereby the distance between the arms 81, 82 is widest at a defined rest location for a member 7, but decreases with distance along each arm from the defined rest location. As will be described further below, this arrangement applies a restoring force to restore the baseplate to a desired or required rest position relative to the housing. The restoring force can be seen in the embodiment illustrated as an increasing recentering force between members 7 and the crossarm pairs 8 during relative movement between the supported structure 1 and supporting structure 2 in a seismic event, and encourages the members 7 to return to their initial rest position, so as to return the supported structure 1 to its original position relative to the supporting structure 2 following a seismic event.

Figure 12:
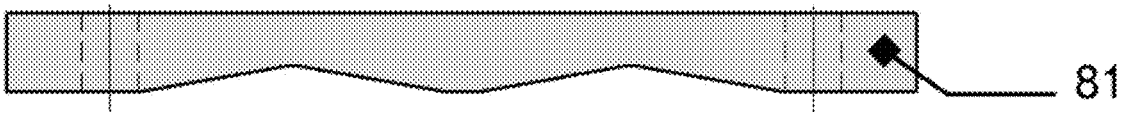
FIG. 12 is a larger view of crossmember part 81 of FIG. 8, in plan.
Figure 13:
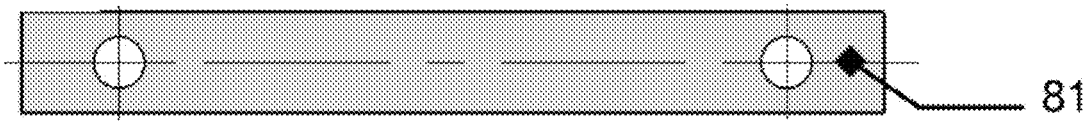
FIG. 13 is a larger view of crossmember part 81 of FIG. 8, in elevation.

It will be seen that only one inner surface of each arm 81, 82 could be contoured in some embodiments. Also, not every movement control region 11 need be constructed having the same contour. FIG. 12 is a plan view which outlines the contours of an arm 81 in one embodiment, however the contour can be varied to enable the seismic device to achieve different properties. The contour may be configured together with the springing arrangement to provide a desired or required degree of seismic dissipation or performance. This same part is shown again in elevation in FIG. 13 to highlight the holes present for clamping assembly 10 to pass through.

Figure 15:
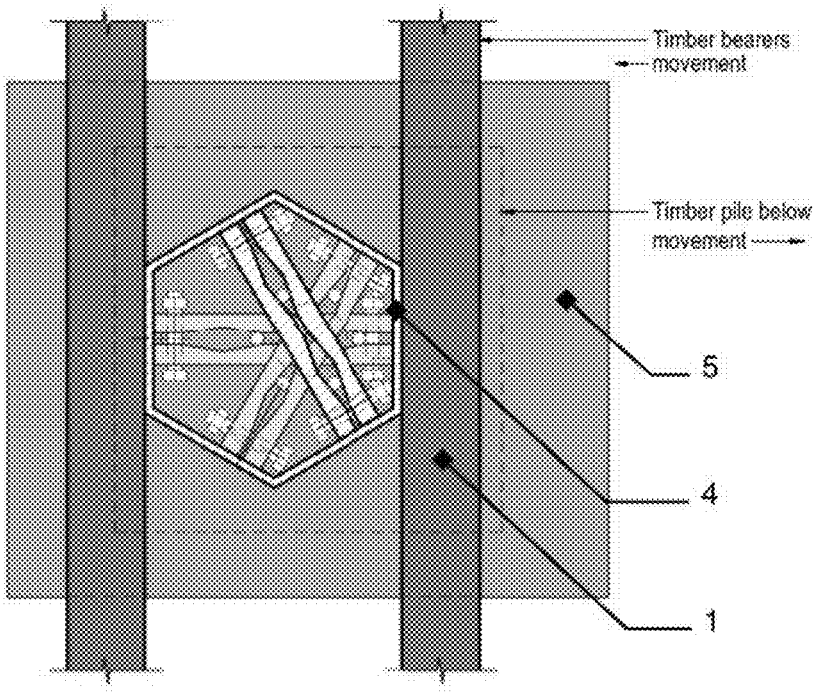
FIG. 15 is a plan view in cross-section of the apparatus in FIG. 1, showing an extreme of its movement in the across-flats principal direction.
Figure 16:
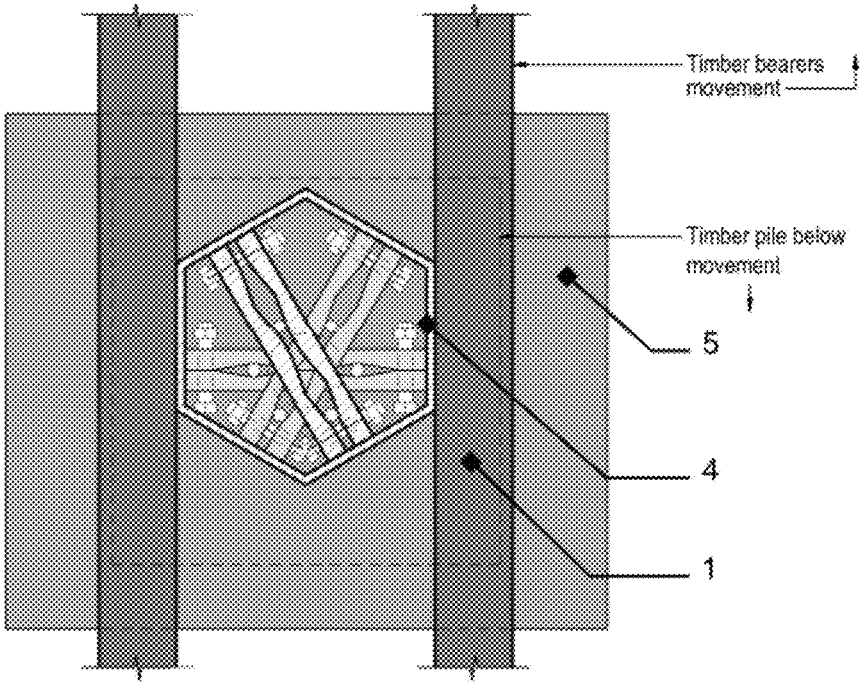
FIG. 16 is a plan view in cross-section of the apparatus in FIG. 1, showing an extreme of its movement in the across-corners principal direction.

Turning to FIGS. 15 and 16, two partial plan views of the device 3 are shown, both with the device 3 activated away from the at rest position as set forth above. FIG. 15 shows the housing 4 pushed to the left relative to the baseplate member 5 and elongated members 7, with elements 5 and 7 moving towards a flat side of the housing 4, known herein as across-flats movement. Crossmember pairs 8 are shown displaced to varying degrees along their axial direction and are pushed apart to varying degrees through compression of springing mechanism 9 on clamping assembly 10. The crossmember pairs are also shown displaced to varying degrees along orthogonal housing 4 sides to allow the overall movement of the device 3 to occur. FIG. 16 shows similar characteristics to those outlined for FIG. 15, however, in this case the movement of the housing 4 is upwards relative to parts 5 and 7, towards a corner of the housing 4, known herein as across-corners movement.

FIGS. 15 and 16 outline the two extremes of movement of this preferred embodiment, but the device 3 is able to move in all directions in the horizontal plane with a combination of these two movement characteristics, across-flats and across-corners.

It will be apparent from the foregoing that the arrangement shown in FIGS. 4 to 14 allows a plurality of (in this example three) primary axes of movement, so that there is control of the multi-axis movement that typically occurs in an earthquake. It will be seen that two orthogonal axes may be provided in some embodiments, or four or more axes could be provided in others. Not only does the apparatus resist movement and absorb energy, but it is also adapted to return the structure to its initial rest position.

The invention claimed is:

1. A seismic device comprising:

a housing configured to be engaged with a first structure; and a plurality of pairs of crossmembers associated with the housing, each pair of cross members being configured to receive a baseplate member or a part of the baseplate member, wherein the baseplate member is configured to be engaged with a second structure, the crossmembers of each pair are biased toward each other to thereby provide a frictional force to the baseplate member to resist axial movement of each crossmember pair relative to the baseplate member, and the crossmember pairs each have a center and overlap at the centers.

2. The seismic device of claim 1 wherein the crossmembers are configured to provide a restoring force to the baseplate member.

3. The seismic device of claim 2 wherein the restoring force comprises a recentering force.

4. The seismic device of claim 1 wherein the axial movement comprises movement along or parallel to a longitudinal axis of the crossmember or crossmember pair.

5. The seismic device of claim 4 wherein the baseplate member extends substantially perpendicularly to the longitudinal axis.

6. The seismic device of claim 1 wherein the baseplate member is provided on the second structure.

7. The seismic device of claim 1 wherein the crossmember pairs are disposed perpendicularly relative to the baseplate member.

8. The seismic device of claim 1 wherein the crossmember pairs are substantially equally angularly disposed relative to each other.

9. The seismic device of claim 1 wherein there are at least two crossmember pairs.

10. The seismic device of claim 1 wherein the ends of each crossmember pair abut a wall of the housing.

11. The seismic device of claim 10 wherein the crossmember pairs are free to move parallel to the wall of the housing.

12. The seismic device of claim 1 wherein at least one crossmember pair has a movement control region to control movement of the baseplate member.

13. The seismic device of claim 1 wherein the baseplate comprises a plate and one or more projecting members.

14. The seismic device of claim 1 wherein the first structure comprises a supported structure and the second structure comprises a supporting structure.

15. The seismic device of claim 1 wherein the device comprises a seismic dissipator.

16. A structure comprising the seismic device according to claim 1.

17. A seismic dissipation apparatus comprising:

a housing configured to be engaged with a first structure; and a plurality of pairs of crossmembers associated with the housing, each pair of cross members being configured to receive a part of a baseplate member, wherein the crossmembers of each pair are biased toward each other to thereby provide a frictional force to the baseplate member to resist axial movement of each crossmember pair relative to the baseplate member, and the crossmember pairs each have a center and overlap at the centers.

18. The seismic dissipation apparatus of claim 17 wherein the crossmembers are configured to provide a restoring force to the baseplate member.

19. The seismic dissipation apparatus of claim 18 wherein the restoring force comprises a recentering force.

20. The seismic dissipation apparatus of claim 17 further comprising the baseplate member, wherein the baseplate member comprises one or more projecting members for being received by the crossmembers.

21. A method of seismic dissipation for a structure, the method comprising:

receiving a baseplate member in a plurality of pairs of crossmembers; and biasing the crossmembers of each pair being toward each other to thereby provide a frictional force to the baseplate member to resist axial movement of each crossmember pair relative to the baseplate member, wherein the crossmember pairs each have a center and overlap at the centers.

* * * * *